United States Patent [19]

Eicher

[11] Patent Number: 4,938,619

[45] Date of Patent: Jul. 3, 1990

[54] ARRANGEMENT FOR POSITION INDICATION OF AN EDGE OF SHEET-SHAPED DATA CARRIER

[75] Inventor: Helmut Eicher, Wenden, Fed. Rep. of Germany

[73] Assignee: U.S. Philips Corporation, New York, N.Y.

[21] Appl. No.: 349,728

[22] Filed: May 10, 1989

[30] Foreign Application Priority Data

May 13, 1988 [DE] Fed. Rep. of Germany ..... 3816365

[51] Int. Cl.[5] ..... B41J 29/42

[52] U.S. Cl. ..... 400/708; 271/265; 116/209; 226/10; 226/45

[58] Field of Search ..... 400/708; 271/258, 263, 271/265; 116/209, 283, 322; 226/10, 11, 45

[56] References Cited

U.S. PATENT DOCUMENTS 3,924,848 12/1975 Murakami ..... 271/258

*Primary Examiner*—Edgar S. Burr

*Assistant Examiner*—Ren Yan

*Attorney, Agent, or Firm*—William Squire

[57] ABSTRACT

An arrangement for position indication of an edge of a sheet, which is transported between a lower and an upper guide plate of a printing apparatus, can be simplified and improved with respect to its indication accuracy in that an elastic tape is provided, which extends in the transport direction, which projects with a bulged part into the space between the two guide plates and whose beginning part is fixed and whose end part is slidably journalled, a stationarily journalled electrical sensor being provided, which upon movement of the tape can be activated by its end.

5 Claims, 1 Drawing Sheet

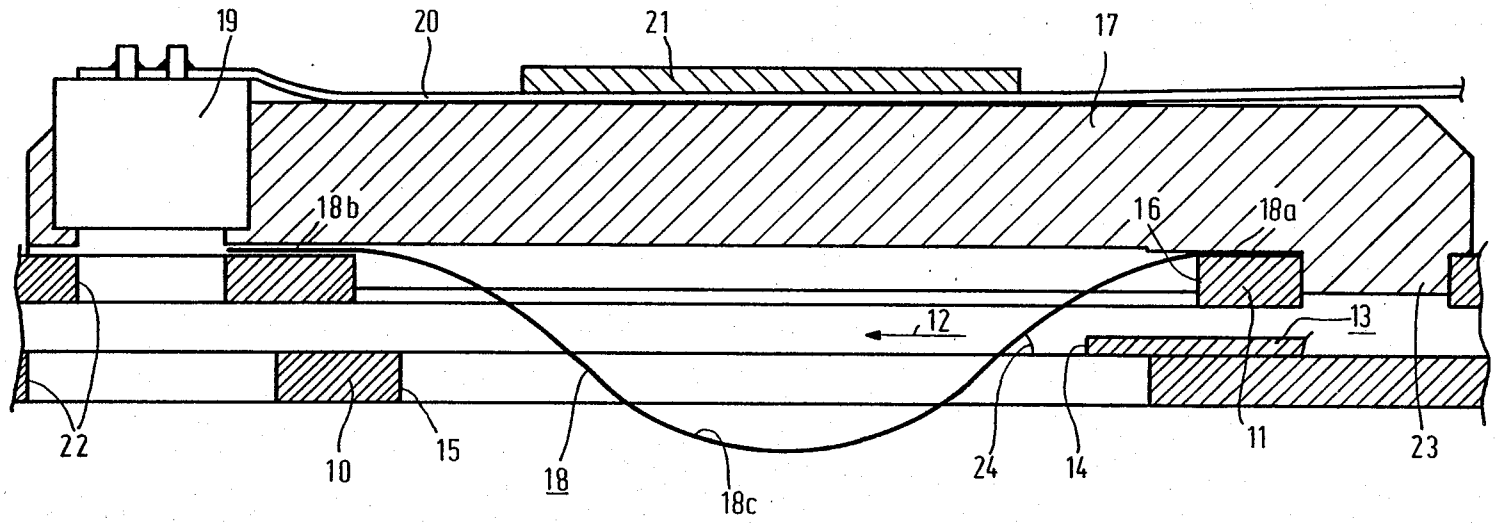
23
13
18a
11
16
17
14
24
12
18c
21
18
20
15
18b
10
19
22

ARRANGEMENT FOR POSITION INDICATION OF AN EDGE OF SHEET-SHAPED DATA CARRIER

The invention relates to an arrangement for position indication of an edge of a sheet-shaped data carrier, which is transported between a lower and an upper guide plate of a printing apparatus.

An arrangement of the kind mentioned in the opening paragraph is known, for example, from German patent application Ser. No. 3535964. The known construction has a catching device for sheet-shaped data carriers to be pulled into a book-keeping machine. This device has a feeding support for the data carriers and sensing levers which are arranged in a line perpendicular to the pulling-in direction and detect the alignment position of the front edge of an inserted data carrier. In the end abutment position of the sensing arms, indication switches are actuated through actuation arms, the pulling-in operation being initiated when these indicator switches are actuated at the same time. In the case of such a mechanical scanning by means of a lever rod system and a microswitch to be actuated, a large switching hysteresis and a large amount of adjustment labour are obtained, further, a comparatively large amount of space is required.

The invention has for its object to simplify an arrangement of the kind mentioned in the opening paragraph and to increase the indication accuracy. In an arrangement of the kind mentioned in the opening paragraph, this object is achieved in that an elastic tape is provided, which extends in the transport direction, which projects with a bulged part into the space between the two guide plates and whose beginning part—viewed in the transport direction—is fixed and whose end part is slidably journalled, and in that a stationary journalled electrical sensor is provided, which upon a movement of the tape can be activated by its end. In the present invention, for recognizing the edge of the sheet-shaped data carrier, a prebent switching tape is used, which is preferably made of thin sheet metal and whose bulged part is extended by the data carrier transported forwards. This length variation of the switching tape is utilized to activate the sensor. The advantages of the invention reside in the particularly flat construction, the simple mounting technique, which is free of mechanical adjustment means, and the high switching accuracy and universal usability of electrical sensors by only small modifications. Preferably, the securing and sliding point of the tape is located on the upper side of the upper guide plate, both guide plates being provided with a recess at the area of the bulged part. The recesses permit the bulged part of being extended without hindrance. A simple construction is obtained in that a housing is provided which can be placed on the upper guide plate, which comprises on its lower side the elastic tape secured to the beginning part and slidably journalled at its end part and has at the area of the edge of the slidable end the sensor stationary journalled on the housing. In this construction, the sensor and the elastic bulged tape are secured to a separate constructional part, i.e. the housing. The latter can be placed in a simple manner on the upper guide plate, for example; it may be secured in an opening of the upper guide plate by snapping.

In the drawing, the Figure shows diagrammatically an embodiment of the arrangement according to the invention. Reference numeral 10 designates a lower guide plate and reference numeral 11 designates an upper guide plate of a paper-guiding device of a printer not shown. Between the two guide plates 10 and 11, a sheet of paper 13 is transported in the transport direction 12, whose front edge is designated by reference numeral 14. The lower guide plate is provided with a recess 15 and the upper guide plate is provided with a recess 16. Reference numeral 17 designates a housing, on whose lower side an elastic metal tape in the form of a switching tape is arranged. Viewed in the transport direction 12, the beginning part **18*a* of the tape 18 is secured to the lower side of the housing, while the end part 18*b* is slidably journalled in the transport direction 12 between the lower side of the housing 17 and the upper guide plate 11. The switching tape 18 extends with a bulged part 18*c* through both recesses 15,16 of the lower and the upper guide plates 10 and 11, respectively. An electrical sensor 19 is arranged at the area of the slidable end part 18*b* of the switching tape 18 and is connected through electrical conductors 20 to an indicator device not shown. Reference numeral 21 designates a mounting clamp and reference numeral 22 designates openings for the sensor 19 in the form of a reflex light barrier. The housing 17 projects with an adjustment pin 23, which at the same time serves to suspend the tape 18, into an opening of the upper guide plate 11. The elastic tape 18 forms with the lower guide plate 10 an acute angle 24 so that the data carrier 13 entering in the direction 12** is always passed along the lower guide plate.

With such an arrangement, for example, a simple and accurate adjustment is possible in the manner described below. By the sheet of paper 13 entering at the angle 24, the tape 18 is extended and causes, upon a given deflection of the tape end **18*b*, an activation of the sensor 19, as a result of which, for example, a switching operation is initiated. The sensor 19 and the tape end 18*b* are arranged with respect to each other so that the activation takes place in a given apparatus always with the same deflection of the tape end 18*b*. After the activation of the sensor 19, upon further transport of the data carrier 13, the steps are counted by which the data carrier 13** must be transported further until it reaches the first printing position.

The high reproducibility of the switching point and the independence of the state of the data carrier (for example transparent foil) are important. The switching instant depends in each apparatus upon different factors (for example upon the bulged part of the tape which is each time present, upon the distance between the paper guide plates), but is constant within one apparatus. Likewise, the transport path from the switching instant to the instant at which the first printing position is reached is subjected to tolerances (for example by the position of the stamping for the sensor housing 17 in the upper guide plate 11 and by the position of incorporating of the guide plates 10, 11 themselves). In order to obtain the exact paper path (countable in steps of a driving stepping motor) from the switching instant to the first printing position, this path is counted out as a number of transporting steps for each apparatus (printer) individually and is stored as a constant in a printer program. By such a process, a whole chain of tolerances is eliminated.

I claim:

1. An arrangement for position indication of an edge of a sheet-shaped data carrier which is transported between a lower and an upper guide plate of a printing apparatus; said guide plates defining a tape transport space therebetween, said arrangement comprising in combination with said apparatus:

an elastic tape extending in the transport direction, said tape having first and second opposing ends, said tape having a flexible bulge portion between said ends extending across said space;

means for fixedly securing one of said ends relative to said guide plates, the other end being free to slidably displace upon deflection of said bulge portion in response to engagement of the bulge portion by said carrier in said space; and sensor means positioned adjacent to said other end for sensing the displacement of said other end upon said deflection.

2. An arrangement as claimed in claim 1 wherein said first and second ends are on a side of the upper guide plate opposite said space, and in that both guide plates have recesses at the area of the bulge portion.

3. An arrangement as claimed in claims 1 or 2, characterized in that said tape other end has an edge and including a housing which is located adjacent to a side of the upper guide plate opposite said space which housing has first and second ends, and a side adjacent to the elastic tape, said first end is arranged to slidably receive the other tape end at the area of the edge of the slidable tape end, said sensor means including a sensor fixed to the housing.

4. An arrangement as claimed in claim 1, characterized in that the housing includes a pin and is secured so that the pin is snap attached to an opening of the upper guide plate.

5. An arrangement as claimed in any one of claims 1–4 characterized by an elastic metal tape.

* * * * *